United States Patent [19]

Johnson

[11] Patent Number: 4,792,308

[45] Date of Patent: Dec. 20, 1988

[54] ELECTRICAL CONNECTOR

[76] Inventor: Raymond L. Johnson, R 4 Box 326, Texarkana, Ak. 75502

[21] Appl. No.: 89,161

[22] Filed: Aug. 25, 1987

[51] Int. Cl.[4] ..... H01R 13/62

[52] U.S. Cl. ..... 439/35; 439/350; 439/372

[58] Field of Search ..... 439/345, 347, 350, 351, 439/372, 34, 35, 289, 292–294, 819, 824

[56] References Cited

U.S. PATENT DOCUMENTS

| | | | |
|---|---|---|---|
| 1,567,474 | 12/1925 | Tomlinson et al. | 339/48 |
| 2,369,860 | 2/1945 | Schroeder | 173/328 |
| 2,723,380 | 11/1955 | Howard | 439/34 |
| 2,761,111 | 8/1956 | Klostermann | 339/91 |
| 3,723,944 | 3/1973 | Gauchat et al. | 339/45 R |
| 3,777,298 | 12/1973 | Newman | 439/372 |
| 4,066,312 | 1/1978 | Faure | 339/48 |
| 4,268,729 | 5/1981 | Gaizauskas | 439/372 |
| 4,390,226 | 6/1983 | Hohn | 339/89 M |
| 4,711,510 | 12/1987 | Orlando, Jr. | 439/294 |

FOREIGN PATENT DOCUMENTS

| | | | |
|---|---|---|---|
| 526562 | 5/1955 | Italy | 439/289 |

*Primary Examiner*—J. Patrick McQuade

*Attorney, Agent, or Firm*—Cushman, Darby & Cushman

[57] ABSTRACT

An improved apparatus for electrically connecting together two cables. The connection is easily coupled and uncoupled and is comprised of a first unit having a number of first contact elements electrically connected to the first cable; and a second unit having a corresponding number of second contact elements electrically connected to the second cable. The first unit includes a pair of spring biased flaps for receiving and holding the second unit thereby forcing the second unit and the second contact members against the complementary contacts in the first unit.

9 Claims, 2 Drawing Sheets

ELECTRICAL CONNECTOR

BACKGROUND OF THE INVENTION

1. Field of the Invention

The present invention relates to a two-piece electrical connector which can be easily coupled and uncoupled. More particularly, the present invention relates to an electrical connector that will not be damaged if sudden forces are applied to the connector assembly.

2. Description of the Prior Art

Electrical connectors of the mating plug and receptacle type have long been used, for example, in the trucking industry, to provide electric power and signals from one area to another, such as from a cab or tractor rearwardly to a trailer. An example of a prior art connector that is in wide use today is disclosed in U.S. Pat. No. 4,390,226 to Hohn. In the Hohn apparatus, a secure connection may be achieved between a receptacle and its mating plug by twisting the plug after it is inserted into the receptacle, because of a number of tracks which are provided in the receptacle for engaging locking projections on the plug. This type of locking engagement is common in prior art connectors, and is especially common among the electrical connectors which have been used throughout the trucking industry.

Although such prior art devices provide a fast, secure electrical connection between a tractor and a trailer, they typically will sustain damage if the mating plug is forceably pulled from the receptacle without first unlocking it. This is a serious disadvantage, particularly since it is common for truckers to forget to disconnect the electrical connectors while unhitching the tractor from the trailer. In addition, prior art connectors such as that disclosed in Hohn are likely to be damaged when the trailer jackknifes with respect to the tractor, thus leaving the trailer without electricity for signals or lights after the driver regains control of the rig. Moreover, prior art connectors such as that disclosed in the Hohn patent were particularly difficult to connect and disconnect in the limited space which exists between a tractor and trailer during hitching.

In view of the above discussed disadvantages of prior art connectors, it is clear that there existed a long and unfilled need for an electrical connector that does not lock, is easily adapted for use with a tractor-trailer rig, is easy to connect and disconnect within a confined space and will not sustain damage when the trailer unexpectedly becomes detached from the tractor.

SUMMARY OF THE INVENTION

It is an object of the present invention to provide an electrical connector that will not be damaged if sudden forces are applied to pull the connector elements apart.

More particularly it is an object of the present invention to provide an electrical connector for a tractor-trailer rig that provides a secure electrical connection between the tractor and the trailer, and that will not be damaged if the trailer unexpectedly separates from the tractor.

In order to attain the above objects, the inventor has developed an improved apparatus for electrically connecting a first cable, which may be attached to a tractor or the like to a second cable which may extend to a trailer or the like. The improved apparatus includes a first unit having a first contact plate with a number of first contact elements which are electrically connected to conductors in the first cable. The apparatus also incorporates a second unit including a second contact plate having a number of second contact elements thereon which are connected to conductors in the second cable. The first and second units are spring biased together so that the second contacts electrically contact the first contact elements, thereby completing the circuit connection. Because of the use of spring bias holding the two units together, a secure electrical connection is achieved between the first and second cables without positively locking the first unit to the second unit, thereby permitting uncoupling when the spring bias force is overcome while simultaneously preventing damage to the first and second units if the two units should suddenly be pulled apart as would occur if the tractor should unexpectedly separate from the trailer.

According to one aspect of the present invention, the second unit may include two rear-side faces which give the second unit a wedge shaped appearance. Spring bias is provided by a pair of flap members that are pivotally mounted to the first unit. These flaps are adapted to engage shaped exterior surfaces of the second unit, thereby in a sense enfolding the second unit and urging its second contacts against the first contacts of the first unit.

The present invention provides an electrical connector such as for a tractor-trailer assembly, that may easily be connected or disconnected especially in the limited space that exists between a tractor and a trailer. The first unit is further formed to allow the second unit to be slid downwardly between the spring biased flap members of the first unit making it unnecessary to space the first contact plate from the second contact plate while connecting or disconnecting the first and second units.

Other objects, features, and characteristics of the present invention, as well as the methods and operation and functions of the related element of the structure, and the combination of parts and economies of manufacture, will become apparent upon consideration of the following description and the appended claims with references to the accompanying drawings, all of which form a part of this specification, wherein like reference numerals designate corresponding parts in the various figures.

DETAILED DESCRIPTION OF THE PREFERRED EXEMPLARY EMBODIMENT

Figure 1:
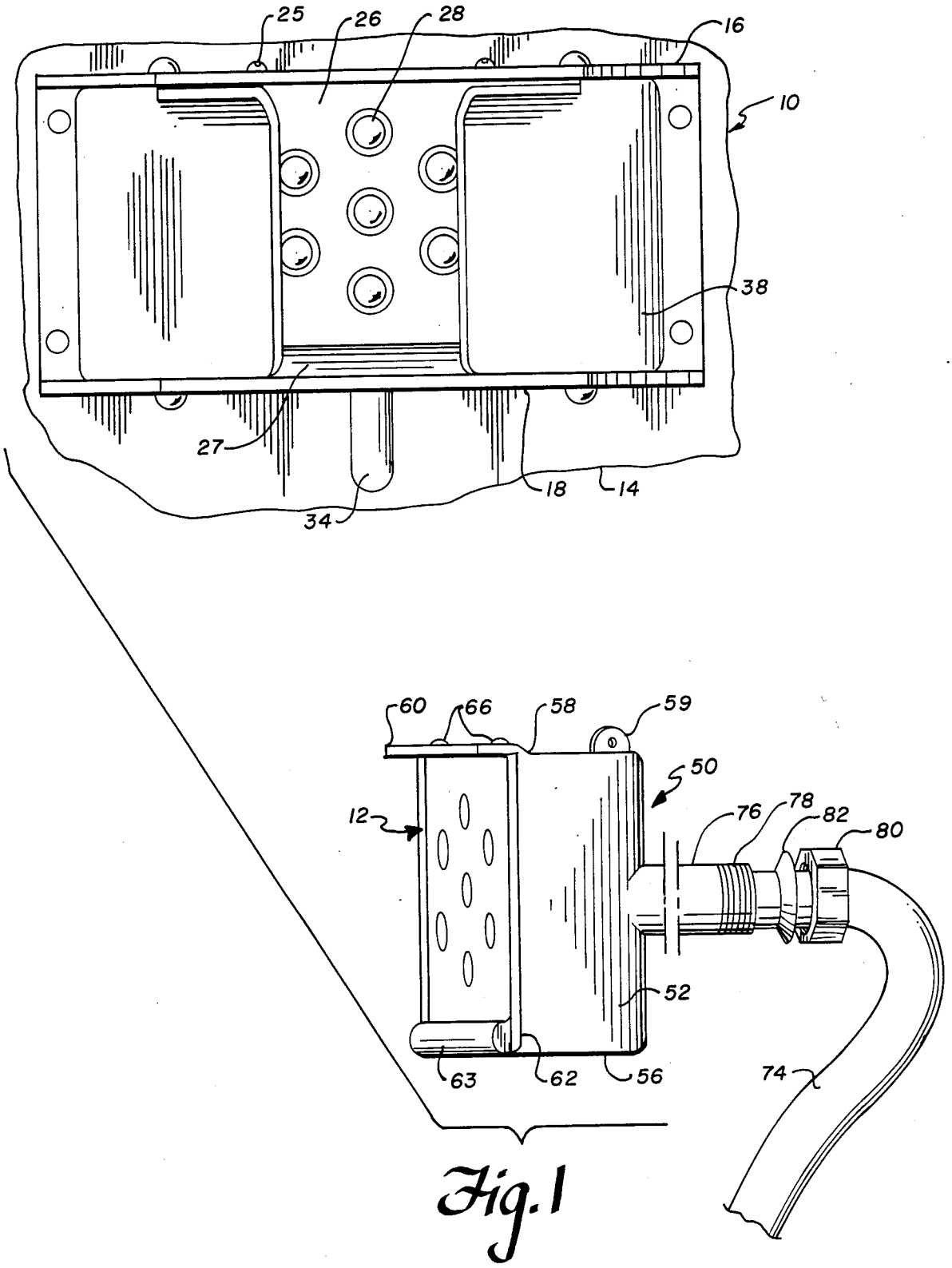
FIG. 1 is an exploded view of the first and second units separated from one another and a preferred embodiment of the present invention.

Referring first to FIG. 1, an apparatus is shown for providing an electrical connection between two members, such as a tractor and its trailer or items aboard a strip or other commercial or residential vehicles or items of equipment, according to the preferred exemplary embodiment of the present invention. This apparatus includes a first coupling unit 10 which is adapted to be mounted to one member such as, for example, a tractor 14, and a second coupling unit 12 that is mounted to another member such as, for example, a trailer, by a flexible conduit 74 with the second unit itself adapted to be connected to the first unit 10.

Figure 2:
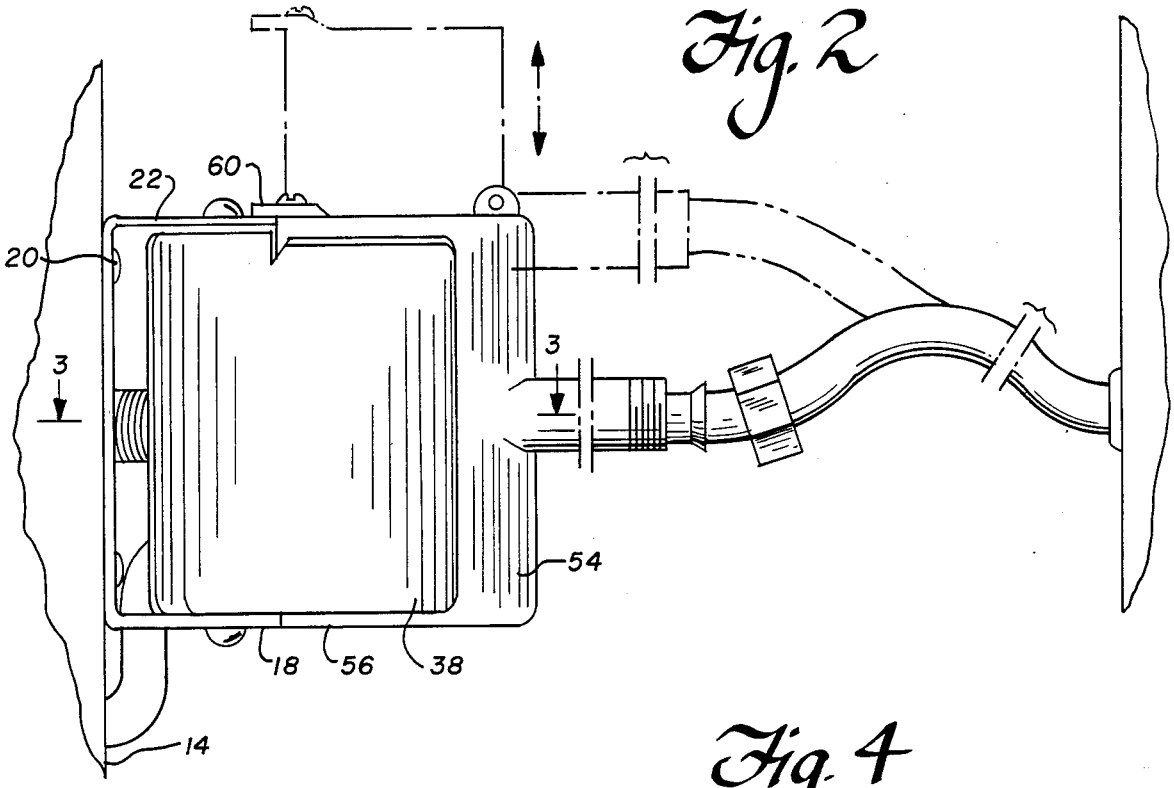
FIG. 2 is a fragmentary side elevational view of the connected first and second units illustrated in FIG. 1.

As illustrated in FIGS. 1 and 2, first unit 10 has an outer housing 16 including a bottom wall 18, a rear wall 20 adapted to be mounted to any surface such as is shown against tractor 14, and a top wall 22 that is substantially perpendicular to rear wall portion 20.

Figure 4:
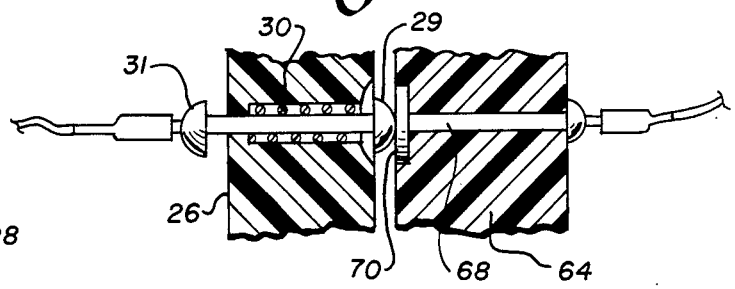
FIG. 4 is an enlarged fragmentary view of the coacting contact elements illustrated in FIG. 3.
Figure 3:
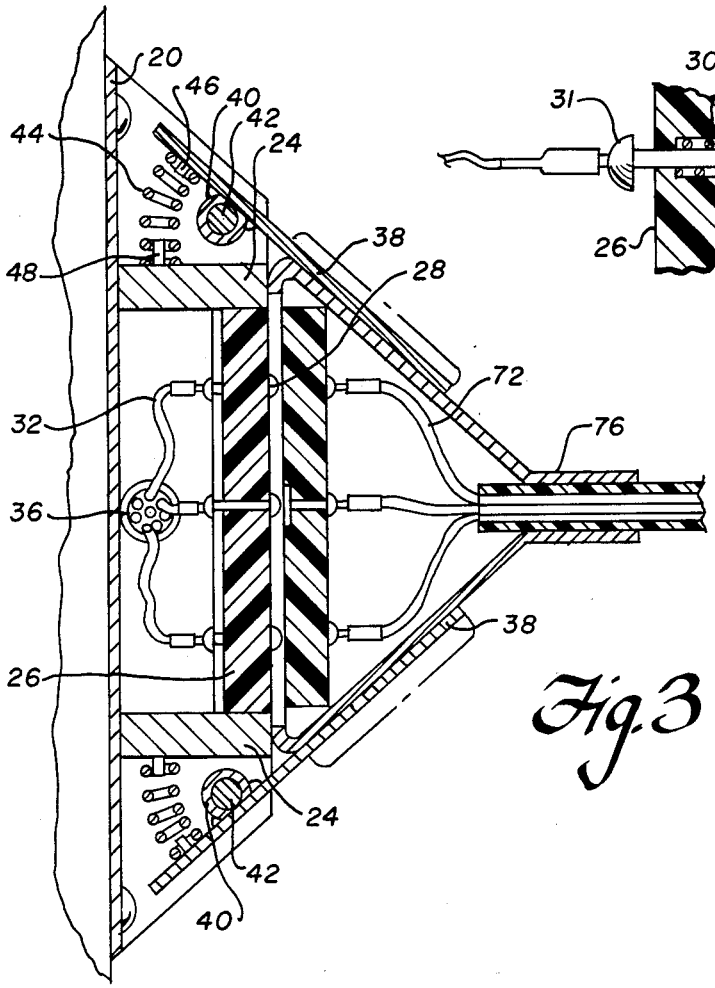
FIG. 3 is a cross sectional view taken along lines 3—3 in FIG. 2.

As best shown in FIGS. 3 and 4, first unit 10 has a pair of contact plate support members 24 which are secured to the rear portion 20 of outer housing 16. A first contact plate 26 is supported by members 24 in a position substantially parallel to the rear portion 20 of outer housing 16, as shown in FIG. 3. As illustrated in FIG. 1, contact plate 26 may be secured adjacent support members 24 by a plurality of mounting screws 25 that are inserted through the top portion 22 of outer housing 16.

As shown in FIGS. 3 and 4, a plurality of first contact elements 28 each having a contact head 29 are provided in first contact plate 26. First contact elements 28 are biased outwardly toward the second unit by a plurality of biasing springs 30, each of which is retained within a recess in first contact plate 26. As shown in FIG. 4, outward motion of each of first contact elements 28 is limited by a stop element 31 which bears against a rear surface of the first contact plate 26. Each of the first contact elements 28 are electrically connected to a trunk cable 34 which extends into the tractor by a plurality of wire members 32. Trunk cable 34 exits outer housing 16 at the bottom portion 18 through an access hole 36.

As best shown in FIG. 3, a pair of retaining flaps 38 are pivotally mounted to the outer housing 16 of the first unit 10 by pivot pins 42 which extend through the outer housing and are fitted within sleeves 40 in the retaining flaps 38. In order to bias the retaining flaps 38 into the closed position as shown in FIG. 3, a compression spring 44 is provided between each of the retaining flaps 38 and one of the contact plates support members 24. Projections 46 and 48 are provided on each of the retaining flaps and contact plate support members, respectively, for securing compression spring 44 in place.

As shown in FIG. 1, the second unit 12 includes an integral main body portion 50 having a wedge-shaped contact housing portion 52. The wedge shaped contact housing portion 52 has a pair of rear-side faces 54 which are formed to be complementary in shape to the area defined by retaining flaps 38 in their closed position, as shown in FIG. 3. In this way, housing portion 52 may be enfolded within the first unit 10. The wedge-shaped contact housing portion 52 further defines a bottom surface 56 and an upper surface 58, which includes an outwardly extending lip portion 60, as shown in FIG. 2.

A second contact plate 64 having stationary second contact elements 68 provided therein forms a front surface of wedge-shaped contact housing portion 52, as is shown in FIG. 1. Second contact plate 64 is kept in place by means of a front retaining wall 62 in the contact housing portion 52 and a plurality of fastening screws 66 which are extended through upper surface 58 of the housing portion. The front retaining wall 62 may have a projection 63 thereon for engaging a recess 27 in the first contact plate 26. This further helps to align the two units after they are connected. Second contact elements 68 are electrically connected to a second trunk cable 74 by means of a plurality of wire elements 72, as shown in FIG. 3. An eye member is provided on the top, surface 58 so that the second unit 12 may be suspended from the trailer b a spring when not in use.

In order to protect second trunk cable 74 against accidental shearing or bending, the integral main body 50 of the second unit 12 is provided with a cylindrical cable protecting projection 76 which extends from a rear portion of contact housing 52, as shown in FIG. 1. The cylindrical projection 76 may also be used as a handle by an operator for connecting or disconnecting the first and second units 10, 12. Projection 76 may have a threaded end portion 78 which is adapted to receive a nut member 80. When nut member 80 is tightened on threaded portion 78, a resilient ferrule or grommet 82 is caused to bear on second cable 74, thus providing additional protection against connector damage during accidental separation.

In operation, first unit 10 may be attached to a rear wall of the tractor portion of a tractor-trailer assembly. Trunk cable 34 may than be connected to a source of electric power within the tractor, and at the same time the second unit 12 may be connected to second trunk cable 74, which leads into the trailer.

As shown in FIG. 2, the second unit 12 may then be inserted into the space defined by the retaining flaps 38 in first unit 10 by sliding the entire second unit downwardly from the position shown in phantom lines in FIG. 2 to the final position where the outwardly extending lip 60 on second unit 12 abuts top portion 22 of the first unit 10, which will ensure that the first contact elements 28 are properly aligned with second contact elements 68. Since the two units may be connected by sliding the second unit downwardly with respect to the first unit, the connection is made easier in situations where there is limited space between the tractor and the trailer.

Once the two units have been connected, the tractor-trailer may be operated as usual. However, if the operator should forget to disconnect the first unit from the second unit while unhitching the tractor, the two units will not be damaged if the tractor is driven away from the trailer. Similarly, neither of the two units will be damaged if the trailer jackknifes with respect to the tractor. In such cases, the wedge-shaped contact housing portion 52 of the second unit 12 will be pulled outwardly from the first unit 10, causing retaining flaps 38 to open against the biasing of compression springs 44, thereby allowing the two units to separate. In this way, neither the first nor second unit will need to be replaced after accidental separation of the tractor from the trailer.

While the invention has been described in connection with what is presently considered to be the most practical and preferred embodiment, it is to be understood that the invention is not limited to the disclosed embodiment, but, on the contrary, is intended to cover various modifications and equivalent arrangements included within the specification and scope of the appended claim.

What is claimed is:

1. An improved apparatus for electrically connecting a first cable to a second cable, comprising:

a first unit including a first contact plate having a number of first contact elements thereon, and means electrically connecting said first contact elements to conductors in the first cable; and a second unit including a second contact plate having a number of second contact elements thereon corresponding to said number of first contact elements and means electrically connecting said second contact elements to conductors in the second cable; and spring biased means pivotally mounted to said first unit for urging said second contact elements of said second unit against said first contact elements of said first unit wherein said spring biased means comprises a pair of flap members pivotally mounted to said first unit, and said second unit includes two rear-side faces which gives the second unit a wedge-shaped appearance and are adapted to be contacted by said flap members, whereby a secure electrical connection is achieved between said first and second cables without positively locking the first unit to the second unit by urging the second contact elements of the second unit against the first contact elements of the first unit.

2. Apparatus according to claim 1, wherein said second unit has an outwardly extending lip extending from an upper surface thereof, whereby said second unit may be slided downwardly within the space defined by said flap members until said outwardly extending lip contacts an upper surface of said first unit.

3. Apparatus according to claim 1, further comprising additional means for biasing said first contact members against said second contact members.

4. Apparatus according to claim 3, wherein each said additional biasing means comprises a compression spring positioned within a recess in said first contact plate and contacting a rear portion of a contact head of one of said first contact members.

5. Apparatus according to claim 1, wherein said first unit is adapted to be fastened to a planar wall of a tractor or the like.

6. Apparatus according to claim 1, further comprising a pair of contact plate support members in said first unit for supporting said first contact plate.

7. Apparatus according to claim 1, further comprising a pair of contact plate support members in said first unit for supporting said first contact plate, each of said support members having first projections on outer sides thereof, each of said flap members having second projections on inner sides thereof; said spring biased means further comprising a compression spring between each of said first and second projections.

8. Apparatus according to claim 1, wherein said second unit includes a rear-wardly extending cylindrical projection for protecting the second cable.

9. An improved apparatus for electrically connecting a first cable extending from a tractor to a second cable extending from a trailer comprising:

a first unit including a first contact plate having a number of first contact elements thereon, and means electrically connecting said first contact elements to conductors in the first cable;

a pair of flap members pivotally mounted to said first unit a second unit including a second contact plate having a number of second contact elements thereon, and means electrically connecting said second contact elements to conductors in the second cable, and second unit including two rear-side faces which give the second unit a wedge-shaped appearance and are adapted to be contacted by said flap members; and first biasing means for urging said flap members against said rear-side faces, whereby said first unit may be secured to said second unit in a breakaway type fashion, without positively locking said first unit to said second unit.

* * * * *